US007927148B2

(12) United States Patent
Chang

(10) Patent No.: US 7,927,148 B2
(45) Date of Patent: Apr. 19, 2011

(54) ELECTRICAL CONNECTOR

(76) Inventor: Nai-Chien Chang, Sanchong (TW)

( * ) Notice: Subject to any disclaimer, the term of this patent is extended or adjusted under 35 U.S.C. 154(b) by 0 days.

(21) Appl. No.: 12/619,784

(22) Filed: Nov. 17, 2009

(65) Prior Publication Data

US 2010/0167588 A1 Jul. 1, 2010

(30) Foreign Application Priority Data

Dec. 22, 2008 (TW) ..... 97223013 U

(51) Int. Cl.
*H01R 13/66* (2006.01)

(52) U.S. Cl. ..... 439/620.16

(58) Field of Classification Search ..... 439/620.22, 439/620.16, 620.12, 620.13, 620.17, 76.1, 439/79

See application file for complete search history.

(56) References Cited

U.S. PATENT DOCUMENTS 4,764,122 A * 8/1988 Sorel et al. ..... 439/66
4,789,847 A * 12/1988 Sakamoto et al. ..... 333/185
4,959,626 A * 9/1990 Mouissie ..... 333/182
4,993,956 A * 2/1991 Pickles et al. ..... 439/76.1
5,118,300 A * 6/1992 Zarreii ..... 439/79
5,395,251 A * 3/1995 Rodriguez et al. ..... 439/66
5,580,280 A * 12/1996 Minich et al. ..... 439/620.22
6,233,153 B1 * 5/2001 Baur et al. ..... 361/752
6,450,837 B1 * 9/2002 Givens et al. ..... 439/620.19
6,537,110 B1 * 3/2003 Korsunsky et al. ..... 439/676
6,547,597 B2 * 4/2003 Harris, IV ..... 439/620.22
6,568,966 B1 * 5/2003 Korsunsky et al. ..... 439/676
7,140,919 B2 * 11/2006 Yu ..... 439/620.13
7,182,649 B2 * 2/2007 Caveney et al. ..... 439/676
7,252,552 B2 * 8/2007 Takimura et al. ..... 439/620.22
7,625,245 B1 * 12/2009 Yao ..... 439/660
7,740,490 B1 * 6/2010 Chang ..... 439/76.1
2003/0194908 A1 * 10/2003 Brown et al. ..... 439/620
2008/0233803 A1 * 9/2008 Renteria et al. ..... 439/620.15
2008/0248695 A1 * 10/2008 Hu et al. ..... 439/620.22
2009/0186526 A1 * 7/2009 Xu ..... 439/620.22
2010/0155489 A1 * 6/2010 Chang ..... 235/486
2010/0159715 A1 * 6/2010 Chang ..... 439/55
2010/0159747 A1 * 6/2010 Chang ..... 439/607.35
2010/0159748 A1 * 6/2010 Chang ..... 439/620.22

* cited by examiner

*Primary Examiner* — T C Patel
*Assistant Examiner* — Vladimir Imas
(74) *Attorney, Agent, or Firm* — Chun-Ming Shih; HDLS IPR Services

(57) ABSTRACT

An electrical connector includes a housing, a seat body, a terminal group, a printed circuit board, and a cover. The housing has a hollow body. The seat body is disposed in the housing. The terminal group is disposed on the seat body. An end of the terminal group electrically connects with the printed circuit board. The printed circuit board electrically connects with a microprocessor. The cover covers a bottom portion of the seat body. Pins of the printed circuit board passes through the cover and electrically connects with a main board of an electronic device, making the microprocessor able to calculate or control the electronic device to execute different functions and operations.

5 Claims, 4 Drawing Sheets

ELECTRICAL CONNECTOR

BACKGROUND

1. Field of the Invention

The present invention relates to an electrical connector, and more particularly, to an electrical connector with control and calculation functions.

2. Description of the Related Art

Electrical connectors refer to all the connecting elements and its accessories applied to electronic products and power supplies. For example, electrical connectors are required between computers and its periphery equipments such as mouse, display, keyboard, printer, and so on. Furthermore, electrical connectors are also required for transforming electric signals between different modules of electronic devices, such as IC connector, board edge connector, and so on. Thus, electrical connectors are most important accessories for electrical products.

Recently, with developments of science and technology, many kinds of new electrical connectors are manufactured, such as USB, HDMI, Displayport, eSATA, SATA. In one aspect, some of the electrical connectors may simplify multiple data lines and improve transmission rate. For example, in the past, at least three date lines are needed during transmitting voice and image, and now, only one HDMI is able to transmit voice and image. In another aspect, some of the electrical connectors of multiple functions may be superposed or joined together to form a multiport electrical connector, making a single multiport electrical connector able to receive multiple data lines of different functions.

Because the forgoing electrical connectors are used for simplifying external wire rod twisting of electronic products, solving information transmission rate and capable of receiving multiple data lines, but provides no suggestion of how to simplify internal structure of the electronic product and the design of the printed circuit board.

BRIEF SUMMARY

The main purpose of the present invention is to build a microprocessor into an electrical connector, for electrical connection of a convention electronic device, and further simplifying design and manufacture of an internal control printed circuit board of the electronic device.

For acquiring such purpose, the present invention provides an electrical connector including a housing, a seat body, a terminal group, a printed circuit board, and a cover. The housing has a hollow body. The hollow body has a receptacle at a front end, and an opening at a rear end for communicating the rear end with a bottom portion of the hollow body. The seat body is disposed in the housing and has a baffle wall at a front end. The baffle wall extends a supporting portion, and further defines a slot, allowing the terminal group passing through. The seat body has a hollow opening at a rear end for communicating the rear end with a bottom portion of the seat body. Two indentations are formed at opposite sidewalls of the hollow opening. The terminal group is composed of a plurality of conductive legs. An end of each of the conductive legs is disposed on the supporting portion, and the other end of each of the conductive legs extends outside of the hollow opening. The printed circuit board electrically connects with a microprocessor disposed thereon, for executing data calculation and controlling. The printed circuit board has a plurality of sockets at an end. Corresponding ends of the conductive legs extend outside the hollow opening, being inserted into the sockets and further electrically connect with the printed circuit board. The printed circuit board has a plurality of pins at the other end. The pins electrically connect with a main board of the electronic product. The cover is disposed in the hollow opening. The pins pass through through holes of the cover and electrically connect with the main board of the electronic product.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
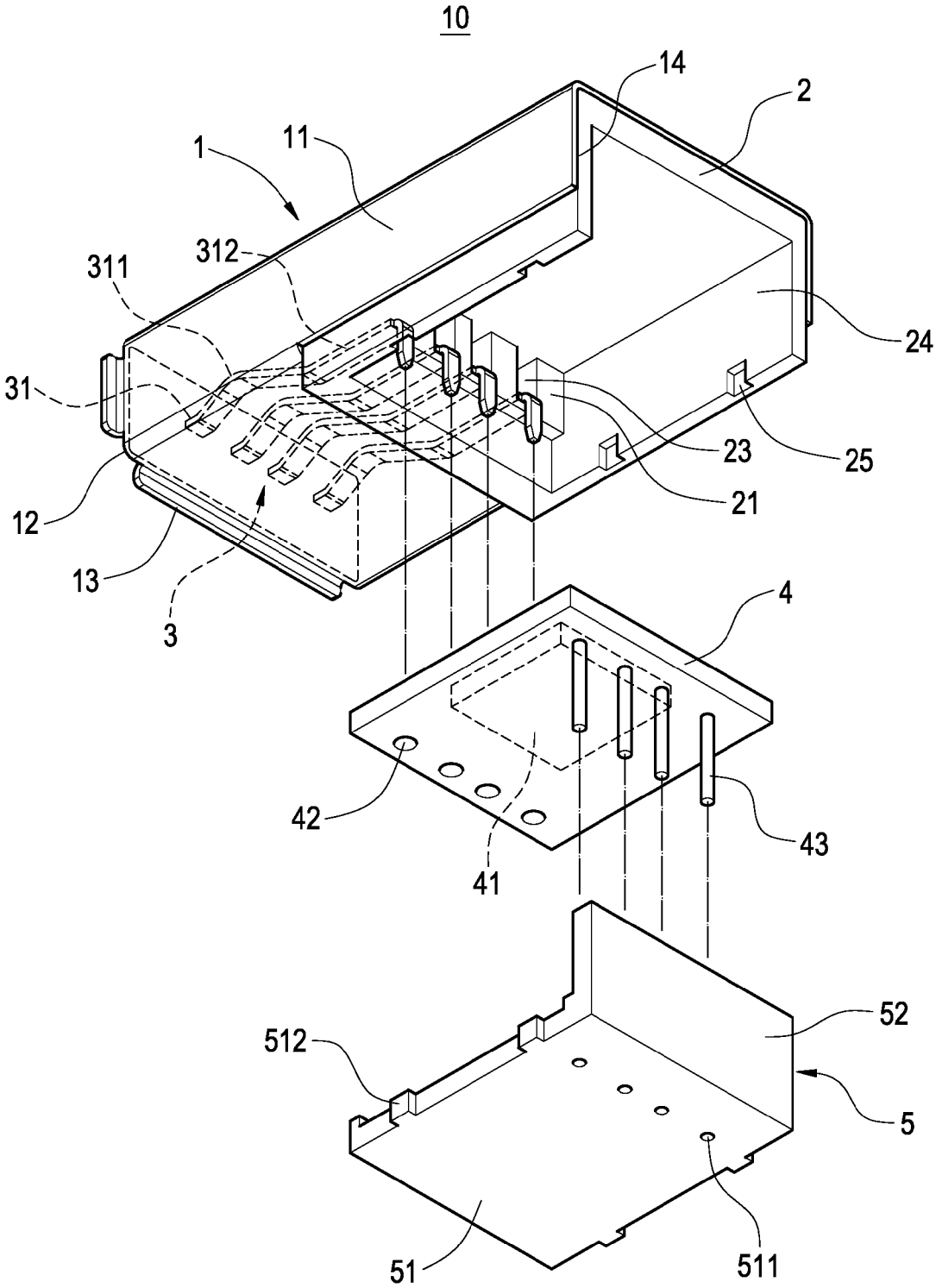
FIG. 1 is a schematic, exploded view of an electrical connector of one embodiment of the present invention.
Figure 2:
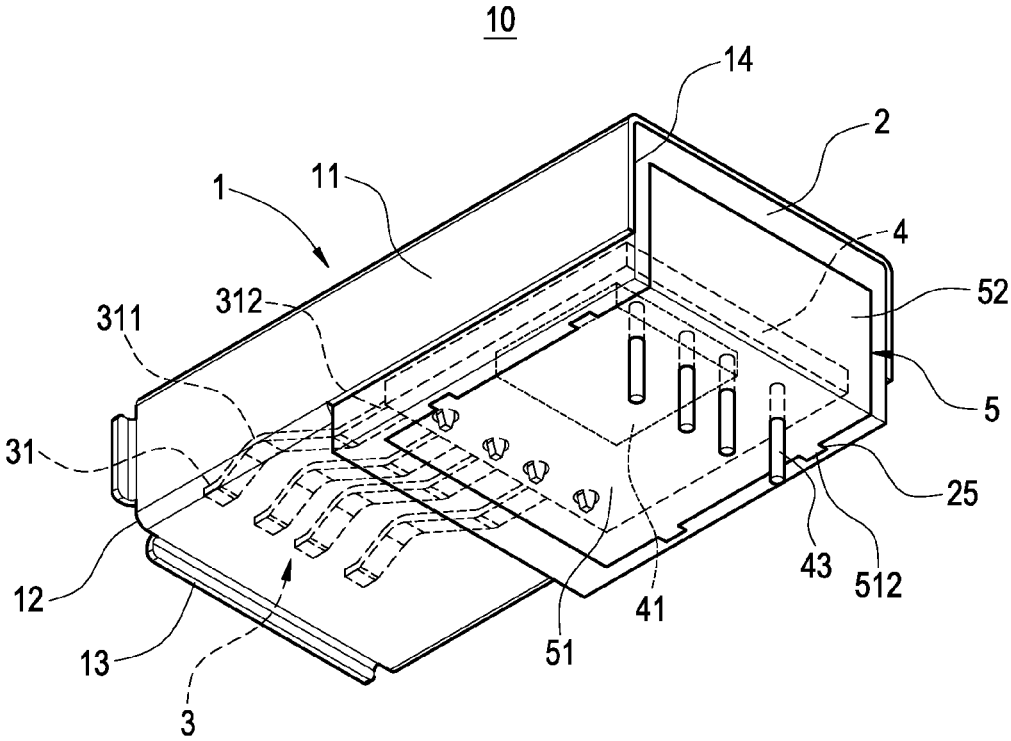
FIG. 2 is a bottom, assembled view of the electrical connector of the present invention.
Figure 3:
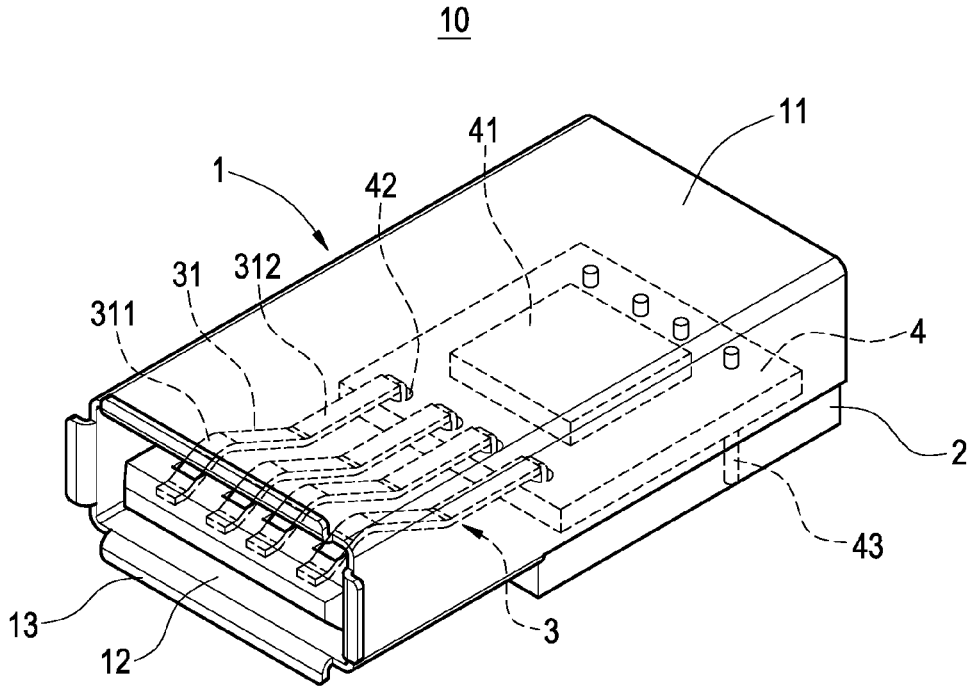
FIG. 3 is an assembled view of the electrical connector of the present invention, but viewed from another aspect.
Figure 4:
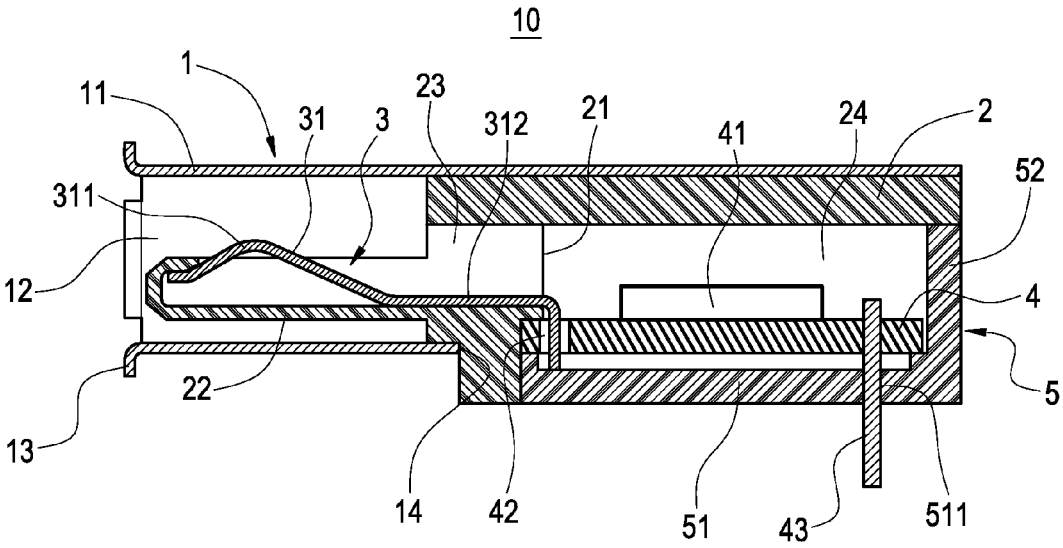
FIG. 4 is a side cross sectional view of the electrical connector of the present invention.

FIG. 1 is a schematic, exploded view of an electrical connector of one embodiment of the present invention. FIG. 2 is a bottom, assembled view of the electrical connector of the present invention. FIG. 3 is an assembled view of the electrical connector of the present invention, but viewed from another aspect. FIG. 4 is a side cross sectional view of the electrical connector of the present invention. Referring to FIGS. 1 to 4, the electrical connector 10 of the present invention includes a housing 1, a seat body 2, a terminal group 3, a printed circuit board 4 and a cover 5.

The housing 1 is a hollow body 11 made of metal. The hollow body 11 has a receptacle 12 at a front end. A periphery of the receptacle 12 has a plurality of arc-shaped baffle plates 13. The hollow body 11 has an opening 14 at a rear end, communicating the rear end with a bottom portion of the hollow body 11.

The seat body 2 is made of plastic and is disposed in the housing 1. The seat body 2 has a baffle wall 21 at a front end. The baffle wall 21 extends a supporting portion 22. The baffle wall 21 further defines a slot 23, allowing the terminal group 3 passing through with an end of the terminal group 3 extending on the supporting portion 22. The seat body 2 has a hollow opening 24 at a rear end, communicating the rear end with a bottom portion of the seat body 2. Two indentations 25 are formed at opposite sidewalls of the hollow opening 24.

The terminal group 3 is composed of a plurality of conductive legs 31. Each of the conductive legs 31 has a first step 311 and a second step 312. The first step 311 is in arc profile and is disposed on the supporting portion 22. The second step 312 is L-shaped and is disposed in the slot 23, while the second step 312 extends outside of the hollow opening 24.

The printed circuit board 4 has a microprocessor 41 disposed thereon. The microprocessor 41 acts as a device for executing data processing and controlling. The printed circuit board 4 has a plurality of sockets 42 at an end. Corresponding ends of the second steps 312 are inserted into the sockets 42 and electrically connect with the printed circuit board 4. The printed circuit board 4 has a plurality of pins 43 at the other end, for electrically connecting with a main board of an electronic device (not shown).

The cover 5 is an L-shaped body made of plastic, and includes a first cover 51 and a second cover 52. The first cover 51 defines a plurality of through holes 511, allowing the pins 43 passing through. The first cover 51 has two protrusions 512 at opposite sides for joining with the indentations 25. When the cover 5 is disposed in the hollow opening 24, the pins 43 pass through the through holes 511 of the first cover 51, making the protrusions 512 of the first cover 51 be received in the indentations 25.

Figure 5:
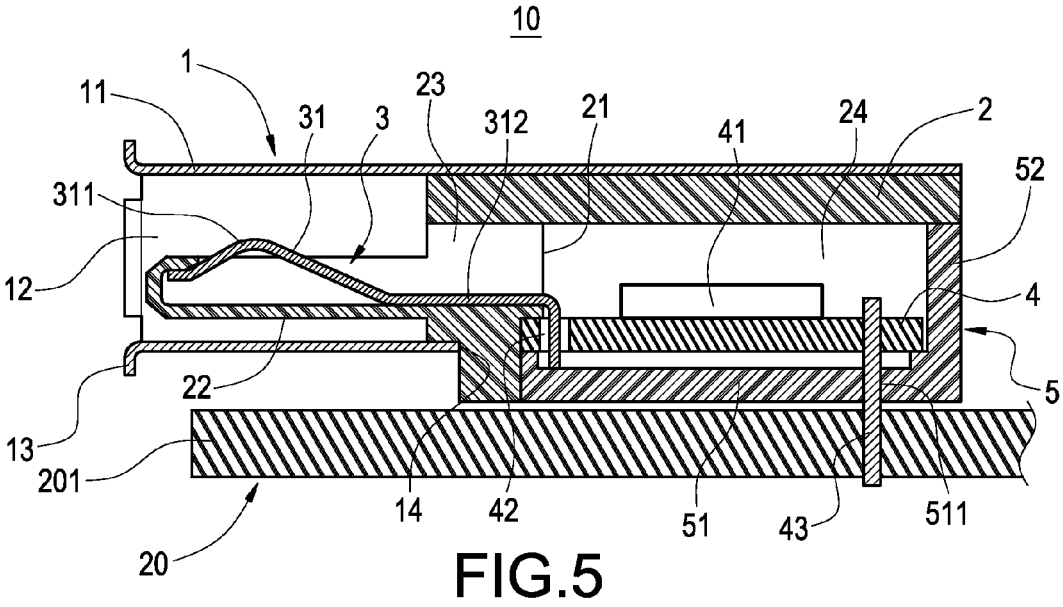
FIG. 5 is a schematic view showing a usage state of the electrical connector of the present invention.

FIG. 5 is a schematic view showing a usage state of the electrical connector of the present invention. Referring to FIG. 5, in usage state, the electrical connector 10 electrically connects with a wiring unit, or the main board 201 of the electronic device 20. After that, a control software or a control procedure may be loaded in a memory of the microprocessor 41 of the printed circuit board 4, making the microprocessor 41 able to control the electronic device 20 to execute different functions.

Figure 6:
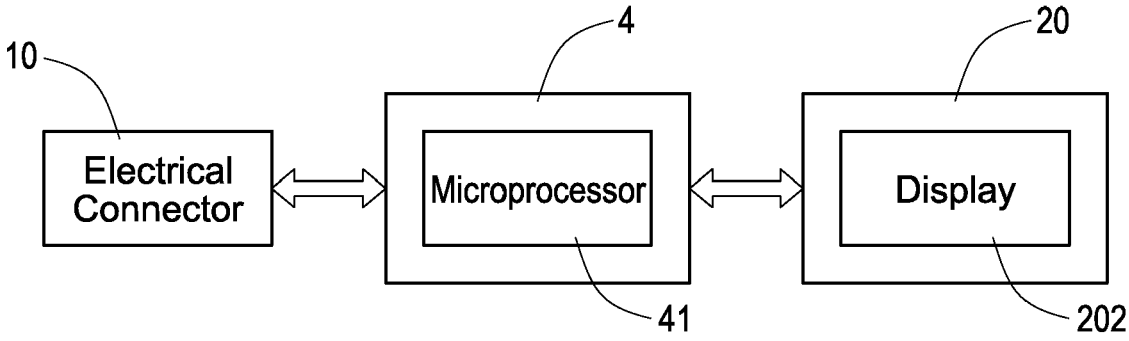
FIG. 6 is a block diagram of showing an electrical connection between the electrical connector and an electronic device.

FIG. 6 is a block diagram of showing an electrical connection between the electrical connector and the electronic device. Referring to FIG. 6, when the electrical connector 10 is electrically connected to an electronic device such as a digital picture frame, a data line is inserted into the electrical connector 10. The control software or procedure, and the image document are input into the memory (not shown) of the microprocessor 41 of the electrical connector 10 by mean of an external computer or a controller. The microprocessor 41 controls the display of the image on a display 201 of the digital picture frame according to the control software or procedure.

In addition, in manufacture of a conventional electric massage chair, the electrical connector 10 with the microprocessor 41 may be joined to the printed circuit board. After loading of the control software or procedure, the microprocessor 41 controls the massage chair to execute different massage operations.

Furthermore, the electrical connector 10 may be selected from USB, HDMI, Displayport, PS/2, eSATA, micro-USB, MINI USB, or IEEE1394.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An electrical connector disposed on a main board of an electronic device, comprising:

a housing having a hollow body, the hollow body having a receptacle at a front end, and an opening at a rear end, the opening communicating the rear end with a bottom portion of the hollow body;

a seat body disposed in the housing, the seat body having a hollow opening at a rear end for communicating the rear end with a bottom portion of the seat body, wherein the seat body has a baffle wall at a front end, the baffle wall baffle defines a slot and extends a supporting portion in the receptacle, and a plurality of indentations are formed at opposite sidewalls of the hollow opening;

a terminal group composed of a plurality of conductive legs and disposed on the seat body, an end of each of the conductive legs extending in the hollow opening, wherein each conductive leg is a one-piece element having a first end passing the slot to extend on the supporting portion and a second end extending in the hollow opening;

an unique printed circuit board disposed within the hollow opening, having a microprocessor for executing data processing and controlling the electronic, a plurality of sockets formed at one side, the second end of each conductive leg being inserted into one corresponding socket and electrically connect with the printed circuit board, and a plurality of pins formed at the other side, the pins being suitable for electrically connecting with the main board; and a cover installed onto the seat body, the cover being an L-shaped body and including a first cover covered on the bottom portion of the seat body and a second cover covered on the rear end of the seat body, the first cover defining a plurality of through holes, allowing the pins of the printed circuit board passing through, the first cover having a plurality of protrusions at opposite sides for respectively engaging with the indentations.

2. The electrical connector according to claim 1, wherein the housing is made of metal.

3. The electrical connector according to claim 1, wherein a periphery of the receptacle has a plurality of arc-shaped baffle plates.

4. The electrical connector according to claim 1, wherein the seat body is made of plastic.

5. The electrical connector according to claim 1, wherein the conductive leg has a first step and a second step, the first step is in arc profile and is disposed on the supporting portion, the second step is L-shaped and is disposed in the slot.

* * * * *